US008899169B1

(12) United States Patent
Jaziri

(10) Patent No.: US 8,899,169 B1
(45) Date of Patent: Dec. 2, 2014

(54) VESSEL PLATFORM WITH INTEGRATED SEATING

(75) Inventor: Chadley Jaziri, Merritt Island, FL (US)

(73) Assignee: Brunswick Corporation, Lake Forest, IL (US)

( * ) Notice: Subject to any disclaimer, the term of this patent is extended or adjusted under 35 U.S.C. 154(b) by 277 days.

(21) Appl. No.: 13/368,661

(22) Filed: Feb. 8, 2012

(51) Int. Cl.
*B63B 17/00* (2006.01)
*B63B 29/04* (2006.01)

(52) U.S. Cl.
USPC ..... 114/363

(58) Field of Classification Search
CPC .. B60N 2/2848; B60N 2/2845; B60N 2/2821; B62B 7/14; B62B 29/04; B62B 2029/043
USPC ..... 114/363, 355; 297/105, 130, 283.1, 14, 297/15
See application file for complete search history.

(56) References Cited

U.S. PATENT DOCUMENTS 4,742,795 A 5/1988 DePrey et al.
5,136,963 A * 8/1992 Zuzik ..... 114/363
D356,289 S 3/1995 Trent
5,443,026 A * 8/1995 Wenstadt et al. ..... 114/61.33
6,230,648 B1 * 5/2001 Davidson et al. ..... 114/363
7,162,969 B2 1/2007 Houlder et al.
7,513,211 B1 * 4/2009 Farb et al. ..... 114/363
8,113,136 B2 * 2/2012 Mayrand et al. ..... 114/363
2009/0249992 A1 * 10/2009 Boggs ..... 114/363
2010/0037814 A1 2/2010 Sahr et al.
2010/0319604 A1 12/2010 Mayrand et al.

* cited by examiner

*Primary Examiner* — Stephen Avila
*Assistant Examiner* — Anthony Wiest
(74) *Attorney, Agent, or Firm* — Malin Haley DiMaggio & Bowen, P.A.

(57) ABSTRACT

A platform for a vessel that includes integrated and stowable seating. The platform comprises a platform surface, at least one seating recess, and at least one seat back panel. The seating recess is disposed below the platform surface. The seat back panel has an inner surface and an opposing outer surface and is pivotably attached to the seating recess to provide a plurality of operative positions, including an open seating position and a closed position. In the closed position, the outer surface of the seat back panel is substantially flush with respect to the platform surface, providing a continuous and unobstructed boarding/swimming platform. The open seating position provides an aftward seating configuration. Both the seating recess and seat back panel can removably receive cushions for added comfort and support of the user. The configuration maximizes usable platform space when the seat back panels are closed.

10 Claims, 5 Drawing Sheets

VESSEL PLATFORM WITH INTEGRATED SEATING

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to marine vessels and more specifically to a vessel having a swimming or boarding platform with integrated, stowable seating.

2. Description of Related Art

Traditional recreational marine vessels incorporate various configurations of platforms at the transom (i.e. stem) of the vessel. The platforms serve a variety of functions including providing a mounting point for an outboard engine, providing a platform to standing, sitting, and boarding/deboarding the vessel, and providing a space for sunbathing and lounging. In some cases, the transom platform is not specifically designed for swimming or diving access, but individuals will still use the platform for ingress/egress. If the platform doesn't provide enough usable space, it can be quite dangerous for boaters. Furthermore, such platforms simply may not provide adequate space for comfortable sitting, sunbathing, and lounging. This results in boaters having to use space inside the hull of the vessel, away from the water, and in closer proximity to the vessel's consoles, support tubing, and other structures. Consequently, it is evident that the transom platform designs typically found in the art do not provide adequate space for comfortable sitting, standing, sunbathing, and lounging. This certainly limits enjoyment of recreational boaters who otherwise desire and need more usable space.

Several attempts at providing improved transom platform designs have been attempted. For example, U.S. Patent App. Pub. 2010/0319604 to Mayrand et al., discloses a convertible seat assembly for boat, in which located at the aft section of the vessel and rearwardly facing are a plurality of convertible seat assemblies. Each seat assembly includes a back rest panel and a seat panel which are pivotably connected, and attached by hinges to a rear wall of the vessel. These seats form a rest bench in stowed configuration, as well as an alternative seating configuration. Mayrand also discloses alternative convertible and rotatable seat configurations, all of which have in common rotatable back or seat sections and hinged components for resting on or about the reboarding platform or swim out deck. The seat sections are generally operable from a vertical configuration above and apart from the swim platform or reboarding deck. Although providing stowable seating, the stowed configurations in Mayrand does not provide an adequate and un-obstructed boarding platform; rather the stowed seats are elevated from the platform surface and obstruct much of the platform.

U.S. Patent App. Pub. 2010/0037814 to Sahr et al. describes a sundeck incorporating a self-stowing rumble seat for a boat. The system is described as a convertible seating system for a sundeck of a boat, in which the sundeck is raised and apart from the swim platform or reboarding section at the stern of the boat. In a stowed configuration, the seat-back lies flush with and forms at least a portion of the sundeck. A separate seating surface is positioned underneath and hidden by the seat back when the system is in its stowed configuration. The seat-back in the self contained system is pivotally connected to the boat structure about a pivot point or access. The seating element is rotated upwardly to reveal a lounger-type seat. A recess is formed in the lower portion of the sundeck, which accommodates the seat-back when the seat is stowed away. The recess is exposed when the seat back is rotated upwardly.

U.S. Design Pat. 356,289 discloses an ornamental aesthetic design for the aft seat section of a recreational boat. The seating is molded into the aft section of the hull and rearwardly facing. The seating is not concealed or convertible and provides limited space for a boarding or swimming platform.

Although the prior art provides some alternative configurations for swimming/boarding platforms having integrated seating, none provides a platform that maximizes available boarding/swimming access while also providing for stowable seating surfaces. Consequently, there is a need for an improved boarding/swimming platform configuration for the transom of a vessel that provides seating surfaces that are stowable to reveal an expanded swimming/boarding surface area.

It is, therefore, to the effective resolution of the aforementioned problems and shortcomings of the prior art that the present invention is directed. However, in view of the vessels having swim platforms in existence at the time of the present invention, it was not obvious to those persons of ordinary skill in the pertinent art as to how the identified needs could be fulfilled in an advantageous manner.

SUMMARY OF THE INVENTION

The present invention concerns a platform for a vessel that includes integrated and stowable seating. In some embodiments, the platform comprises a platform surface, at least one seating recess, and at least one seat back panel. The seating recess is disposed below the platform surface. The seat back panel has an inner surface and an opposing outer surface and is pivotably attached to the seating recess to provide a plurality of operative positions, including an open seating position and a closed position. In the closed position, the outer surface of the seat back panel is substantially flush with respect to the platform surface, providing a continuous and unobstructed boarding/swimming platform.

In some embodiments, the platform is located and/or integrated into the transom of the vessel, however other locations are contemplated. Accordingly, the open seating position provides a seating configuration that faces aftward with respect to the vessel. Both the seating recess and seat back panel can removably receive cushions for added comfort and support of the user. Furthermore, the seating recess may include a drain plug for liquid drainage, as well as a latch adapted to secure the seat back panel to the seating recess in the closed position. The present invention provides that the platform may include any number of seating recesses and corresponding seat back panels, including two of each in adjacent configuration.

Accordingly, it is an object of the present invention to provide a vessel swimming/boarding platform that includes stowable seating.

It is another object of the present invention to provide a vessel swimming/boarding platform that includes stowable seating that, in a closed position, lays flush to the platform surface so as to not interfere or obstruct the useable surface area.

It is yet another object of the present invention to provide a vessel swimming/boarding platform that maximizes usable platform space while also providing functional and comfortable convertible seating.

In accordance with these and other objects which will become apparent hereinafter, the instant invention will now be described with particular reference to the accompanying drawings.

DETAILED DESCRIPTION

Figure 1:
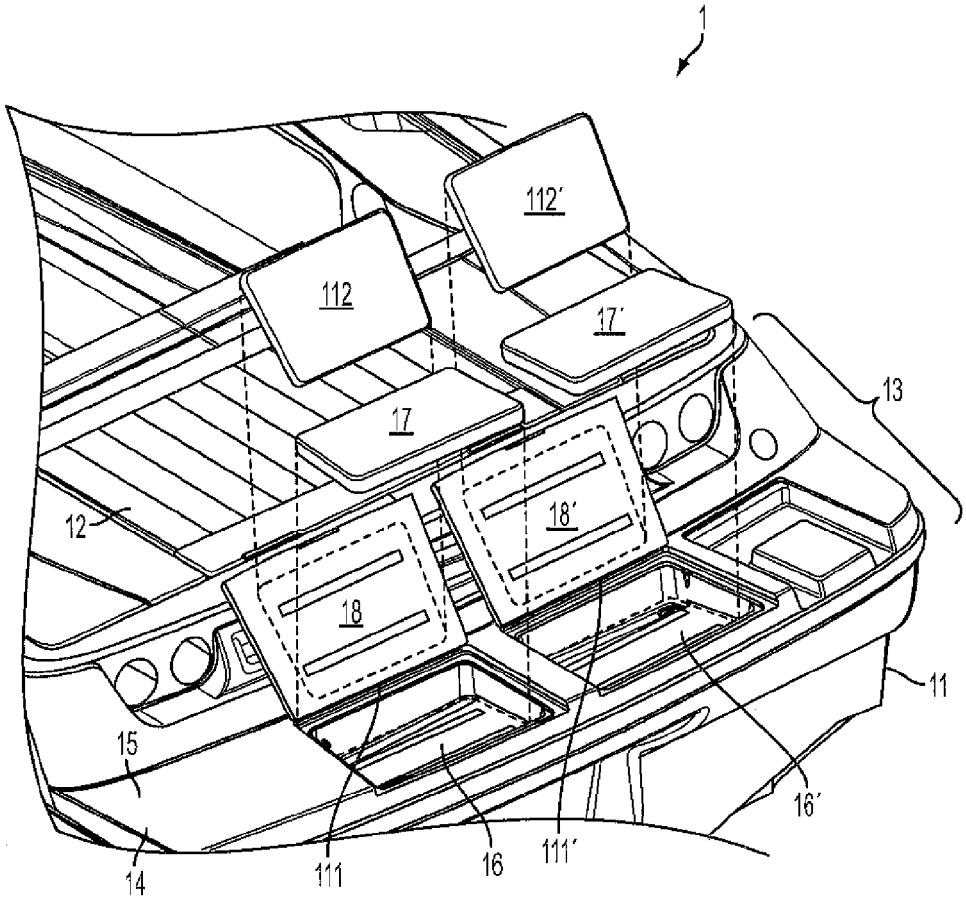
FIG. 1 is a perspective view of the rear of an exemplary vessel including the swim platform of the present invention.

With reference to FIG. 1, shown is a rear perspective view of an exemplary vessel 1. The vessel generally comprises a hull 11 and a deck 12, with the hull 11 providing buoyancy and the deck 12 generally providing delimiting the usable space of vessel 11. The aft (i.e. stern) of the vessel, between the deck 12 and the bottom of hull 11, defines a transom 13 which includes a platform 14. Platform 14 extends generally rearward from the vessel 1 and delimits a platform surface 15.

Platform 14 includes one or more seating recesses 16 and 16' which are deposed below the platform surface 15 the platform 14. Recesses 16 and 16' may be of any shape and size desired, however the depicted embodiment provides rectangular recesses. Recesses 16 and 16' are adapted to removably receive seat-bottom cushions 17 and 17', respectively. Cushions 17 and 17' may be removably attached to the recesses 16 and 16' by attachment means known in the art such as Velcro, double-sided adhesive, button-snap engagements, and the like. In some embodiments, cushions 17 and 17' are permanently affixed within the recesses 16 and 16'. The depth of recesses 16 and 16' can vary depending on the structure of platform 14 and hull 12, as well as the desired thickness of cushions 17 and 17'.

Figure 3:
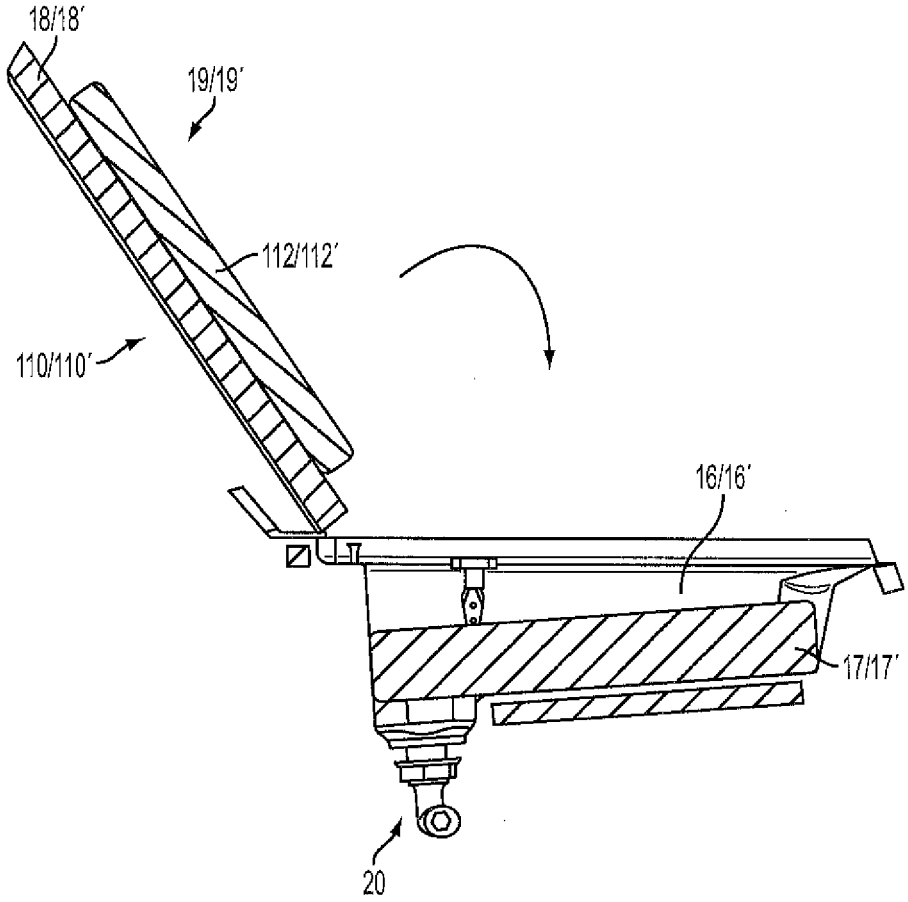
FIG. 3 is a side view of one embodiment of the present invention, with the vessel structure omitted.

Seat back panels 18 and 18' are provided and each includes two opposing surfaces, inner surfaces 19 and 19' and outer surfaces 110 and 110' (See FIG. 3). Seat back panels 18 and 18' are pivotably attached to recesses 16 and 16', respectively, by hinges 111 and 111'. In some embodiments, panels 18 and 18' are secured to the back edge of recesses 16 and 16', respectively, such that panels 18 and 18' pivot upward and toward the bow of the vessel 11. The inner surfaces 19 and 19' are adapted to removably receive seat-back cushions 112 and 112', respectively. Cushions 112 and 112' may be removably attached to the inner surfaces 19 and 19' by attachment means known in the art such as Velcro, double-sided adhesive, button-snap engagements, and the like. In some embodiments, seat-back cushions 112 and 112' are permanently affixed to inner surfaces 19 and 19'.

Panels 18 and 18' are configured to pivot about hinges 111 and 111' in order to provide at least two operative positions. Accordingly, seat back panels 18 and 18' provide "convertible" or "flip-out" seating. With panels 18 and 18' opened completely, a seating or lounging position is defined, as show in FIGS. 1, 2, 3, and 4B, with the inner surfaces 19 and 19' support an individual's back and recesses 16 and 16' supporting an individual's bottom. In the depicted embodiments, the seating position face aftward, out of the rear of vessel 1. In the seating position, panels 18 and 18' may be supported against over-pivoting by the structure of the transom, by the hinges 11 and 11', or by strakes connected between the panels 18 and 18' and recesses 16 and 16'. In a second operative position, with panels 18 and 18' closed over recesses 16 and 16' as show in FIG. 4A, the outer surfaces 110 and 110' of the panels 18 and 18' are substantially flush (i.e. even or level) with the platform surface 15 and, therefore, the present invention provides a contiguous and substantially planar swimming/diving/boarding/sunbathing platform. As such, the present invention provides stowable seating that, in a stowed position, maximizes the useable surface area of platform 14 and platform surface 15.

Figure 2:
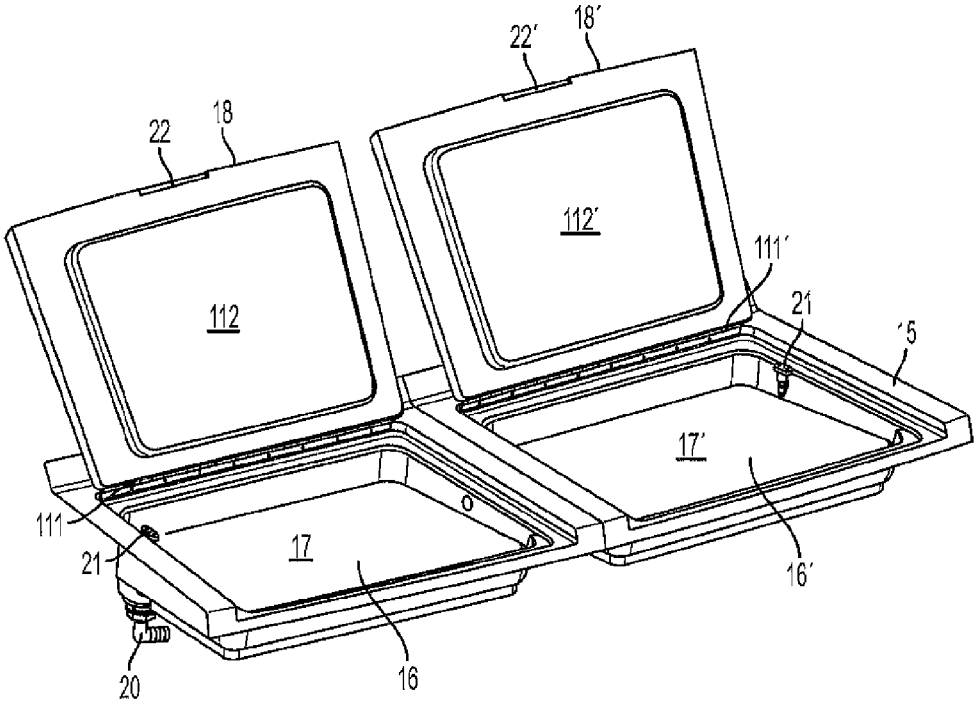
FIG. 2 is another perspective view of one embodiment of the present invention, with the vessel structure omitted.

FIG. 2 shows the components of the present invention isolated from vessel 1 and platform 14 and with cushion 17, 17', 112, and 112' attached to their respective structures. Also shown is a drain plug 20 which allows for any liquid in recesses 15 and 15' to drain downward and away from the seating recesses. Furthermore, in some embodiments, each of the recesses 15 and 15' may include a latch 21, which provides a means for securing panels 18 and 18' respectively, when the seating configuration is in the closed position. This prevents inadvertent movement of panels 18 and 18' about hinges 111 and 111' during operation of the vessel or when the seating configuration is otherwise not in use. Also shown are notches 22 and 22' at the leading edge of the seat back panels 18 and 18', respectively, which provide an access point for a user's hand or other implement to open and close the panels 18 and 18' safely, without coming into contact with one or more of the edges of the recesses 16 and 16'

Figure 4A:
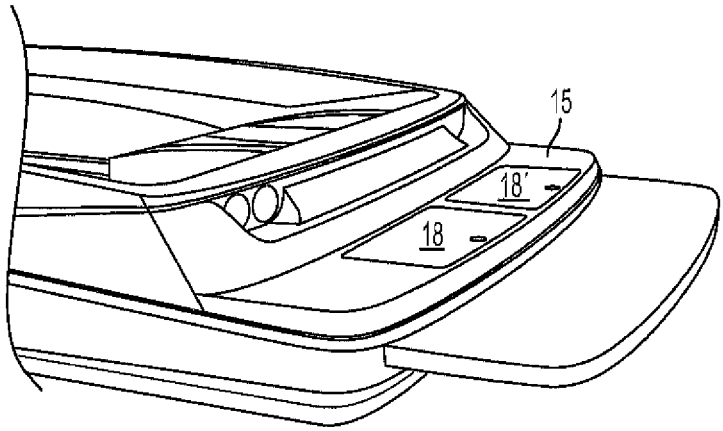
FIG. 4A is a perspective view of one operative position of the present invention.
Figure 4B:
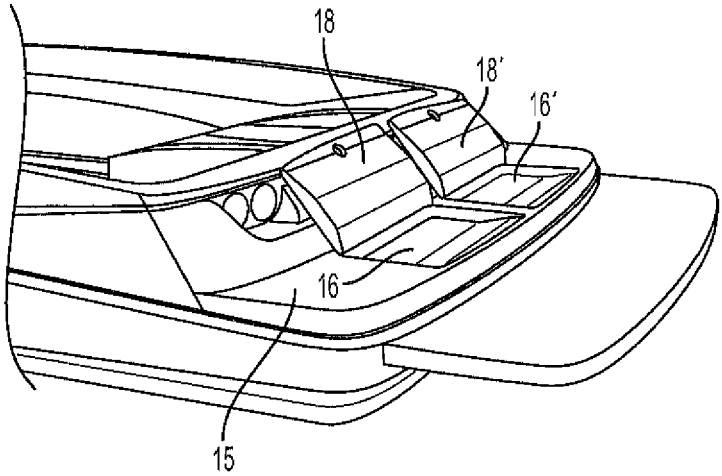
FIG. 4B is a perspective view of another operative position of the present invention.
Figure 5:
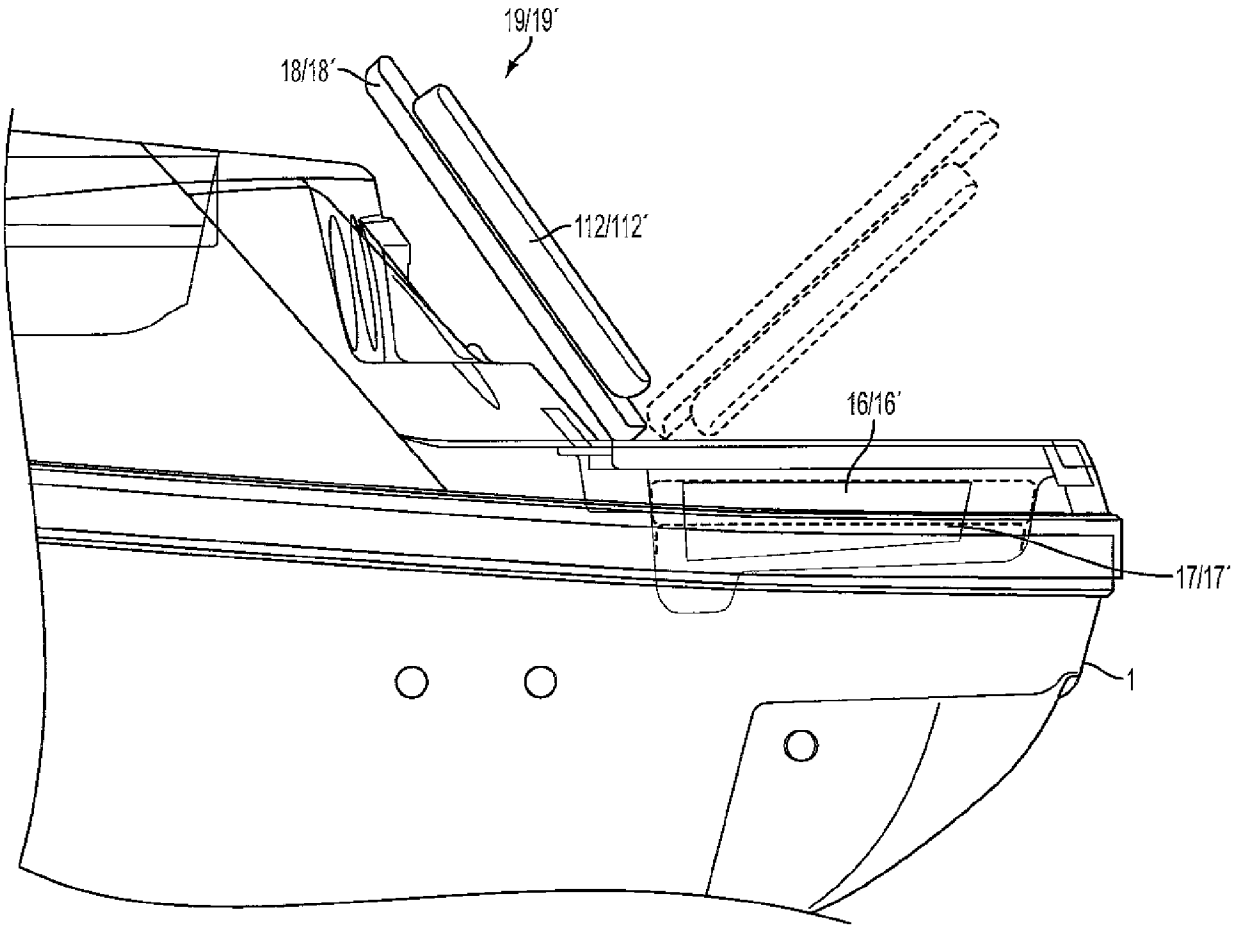
FIG. 5 is another side view of one embodiment of the present invention, shown integrated into a vessel.

FIG. 3 is a side view of one embodiment of the present invention, showing the structural features described in detail above. FIGS. 4A and 4B depict two of the operative positions contemplated by the present invention, with FIG. 4A showing the closed position, wherein panels 18 and 18' lay flush with platform surface 15, defining a contiguous and expansive platform and with FIG. 4B showing the opened position, defining at least two seats for sitting, lounging, and even recreational activities such as fishing. FIG. 5 similarly shows the operative positions of panels 18 and 18', including an intermediate position.

For purposes of this disclosure, the function and purpose of the platform 14 should not be construed as limiting. Platform 14 may be utilized as a "swimming platform" or "boarding platform", however it is appreciated that such modifiers are not intended to limit the functionality of the structure, but are merely used for convenience and explanation. Accordingly, platform 14 can serve any function so desired, including providing access from the boat to the water, and from the water to the boat, at the aft of vessel 1. The platform 14 can also function as a sundeck for sunbathing, lounging, or for any other similar purpose. Furthermore, the specific geometry of platform 14 with respect to transom 13 and vessel 11, generally, need not be construed as limited to the configurations shown herein. There are a variety of vessel configurations that are suitable for including the seating structure contemplated by the present invention. Further still, the size and quantity of the seating recesses and seat back panels can be varied depending on the size and configuration of the vessel 1 and the number of seats desired. For example, the embodiments depicted herein include two seating recesses and corresponding seat back panels arranged adjacent to each other.

However, a platform could be provided which includes only a single seating recess and corresponding seat back panel. Likewise, a platform could be providing having three seating recess and three corresponding seat back panels.

In light of the foregoing description and the attendant drawings, it is readily apparent that the present invention provides a significant advantage over the previous seating structures and systems known in the art. While the prior art has provided for certain seating structures at the transom or boarding platform of a vessel, none has described a stowable system that, when closed, provides a completely contiguous and integrated platform surface wherein the seating structures do not interfere with or occupy any usable surface area of the platform. Further still, the present invention provides for comfortable and functional convertible seating for sunbathing, lounging, fishing, and other uses. It is also appreciated that platform/seating configuration of the present invention does not have to be located at the aft or transom of the vessel, but rather could be integrated into any section of a vessel as desired, depending on the physical dimensions and geometry thereof.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A platform for a vessel having an aft deck and a transom, comprising:

said aft deck being forward of said transom;

said transom having a first generally vertical section and a second rearward platform section;

said platform section having a generally horizontal platform surface;

at least one seating recess, and at least one seat back panel;

said seating recess disposed below said platform surface;

said seat back panel having an inner surface and an opposing outer surface;

said seat back panel pivotably attached to said seating recess to provide an open seating position and a closed position; and wherein, in said closed position, said outer surface of said seat back panel is substantially flush with respect to said platform surface.

2. The platform of claim 1, wherein said open seating position faces aftward with respect to said vessel.

3. The platform of claim 1, wherein said seating recess receives a seat bottom cushion.

4. The platform of claim 3, wherein said seat bottom cushion is removable.

5. The platform of claim 1, wherein said inner surface of said seat back panel receives a seat back cushion.

6. The platform of claim 5, wherein said seat back cushion is removable.

7. The platform of claim 1, wherein said seating recess includes a drain plug.

8. The platform of claim 1, wherein said at seating recess includes at least one latch, said latch adapted to secure said seat back panel to said seating recess in said closed position.

9. A platform for a vessel having an aft deck and a transom, comprising:

said aft deck being forward of said transom;

said transom having a first generally vertical section and a second rearward platform section;

said platform section having a generally horizontal platform surface;

a first and a second seating recess, and a first and a second seat back panel;

each of said seating recesses disposed below said platform surface;

each of said seat back panels having an inner surface and an opposing outer surface;

said first seat back panel pivotably attached to said first seating recess and said second seat back panel pivotably attached to said second seating recess, each said seat back panel pivoting to provide an open seating position and a closed position; and wherein, in said closed position, said outer surface of each of said seat back panels is substantially flush with respect to said platform surface.

10. A platform for a vessel having an aft deck and a transom, comprising:

said aft deck being forward of said transom;

said transom having a first generally vertical section and a second rearward platform section;

said platform section having a generally horizontal platform surface;

at least one seating recess, and at least one seat back panel;

said seating recess disposed below said platform surface;

said seat back panel having an inner surface and an opposing outer surface;

said seat back panel pivotably attached to said seating recess to provide plurality of operative positions, including a closed position; and wherein, in said closed position, said outer surface of said seat back panel is substantially flush with respect to said platform surface.

* * * * *